US011260997B2

(12) United States Patent
Tsuruta et al.

(10) Patent No.: US 11,260,997 B2
(45) Date of Patent: Mar. 1, 2022

(54) VERTICAL BAG-MAKING/FILLING MACHINE AND METHOD FOR PRODUCING CONTENT-FILLED FILM PACKAGING BAG

(71) Applicant: ORIHIRO ENGINEERING CO., LTD., Tomioka (JP)

(72) Inventors: Masataka Tsuruta, Tomioka (JP); Seiichi Imai, Tomioka (JP)

(73) Assignee: ORIHIRO ENGINEERING CO., LTD., Tomioka (JP)

( * ) Notice: Subject to any disclaimer, the term of this patent is extended or adjusted under 35 U.S.C. 154(b) by 211 days.

(21) Appl. No.: 16/336,555

(22) PCT Filed: Oct. 3, 2016

(86) PCT No.: PCT/JP2016/079280

§ 371 (c)(1),
(2) Date: Mar. 26, 2019

(87) PCT Pub. No.: WO2018/066029

PCT Pub. Date: Apr. 12, 2018

(65) Prior Publication Data

US 2020/0017245 A1 Jan. 16, 2020

(51) Int. Cl.

| | |
|---|---|
| ***B65B 9/13*** | (2006.01) |
| ***B65B 9/12*** | (2006.01) |
| ***B65B 61/00*** | (2006.01) |

(52) U.S. Cl.

CPC ..... *B65B 9/13* (2013.01); *B65B 9/12* (2013.01); *B65B 61/005* (2013.01)

(58) Field of Classification Search

CPC ..... B65B 9/13; B65B 9/12; B65B 61/005

(Continued)

(56) References Cited

U.S. PATENT DOCUMENTS 3,849,965 A 11/1974 Dominici
3,925,963 A * 12/1975 Greenawalt ..... B29C 66/81457 53/552

(Continued)

FOREIGN PATENT DOCUMENTS

JP 48-073295 A 10/1973
JP 49-55486 A 5/1974

(Continued)

OTHER PUBLICATIONS

International Search Report dated Dec. 13, 2016, issued in counterpart International Application No. PCT/JP2016/079280, with English Translation. (5 pages).

(Continued)

*Primary Examiner* — Robert F Long
*Assistant Examiner* — Xavier A Madison
(74) *Attorney, Agent, or Firm* — Westerman, Hattori, Daniels & Adrian, LLP

(57) ABSTRACT

A vertical bag-making/filling machine (1) comprises: a film-feeding unit (8) which intermittently feeds a film (F) formed into a tubular shape downward; a nozzle (10) supplying contents (X) into the film; a sealing-off unit (17) arranged below a lower end of the nozzle and forming a bag body (Fg) by heat-sealing the film in a transverse direction; a lower shaping unit (30) regulating swelling of the film on the lower side of the sealing-off unit; an upper shaping unit (40) regulating the swelling of the film on the upper side of (Continued)

the sealing-off unit; and a separating unit (25) for separating the bag body (G) fully filled with the contents by cutting the transverse seal (Y1, Y2) formed by the sealing-off unit.

15 Claims, 13 Drawing Sheets

(58) Field of Classification Search
USPC ..... 53/451
See application file for complete search history.

(56) References Cited

U.S. PATENT DOCUMENTS 4,073,121 A * 2/1978 Greenawalt ..... B29C 66/1122 53/511
4,077,186 A 3/1978 Voegele
4,215,520 A * 8/1980 Heinzer ..... B65B 9/2042 53/173
4,353,196 A * 10/1982 Beer ..... B26D 1/095 53/451
4,450,669 A * 5/1984 Rapparini ..... B65B 9/12 53/551
5,038,550 A * 8/1991 Wirsig ..... B65B 9/12 53/451
5,473,866 A * 12/1995 Maglecic ..... B65B 1/22 53/151
7,963,090 B2 * 6/2011 Ours ..... B65B 1/28 53/526
2002/0014055 A1 * 2/2002 Iwasa ..... B65B 57/08 53/551
2004/0226265 A1 * 11/2004 Tankersley ..... B65B 9/24 53/411
2013/0061562 A1 * 3/2013 Kastens ..... B65B 59/02 53/452

FOREIGN PATENT DOCUMENTS

JP 52-82588 A 7/1977
JP 11-348911 A 12/1999
JP 2003-40204 A 2/2003
JP 2003-81207 A 3/2003
JP 2005-187024 A 7/2005
JP 2006-341854 A 12/2006
JP 2009-120253 A 6/2009
JP 2011-235942 A 11/2011
JP 2015-231850 A 12/2015

OTHER PUBLICATIONS

Office Action dated Mar. 11, 2019, issued in counterpart JP Application No. 2018-543487, with English translation. (20 pages).
Final Office Action dated Jun. 26, 2019, issued in counterpart JP Application No. 2018-543487, with English translation. (17 pages).
Office Action dated Jul. 28, 2020, issued in counterpart CN Application No. 201680089856.8, with English translation (23 pages).
Office Action dated Jun. 29, 2020, issued in counterpart IN Application No. 201917009847, with English translation (6 pages).

* cited by examiner

VERTICAL BAG-MAKING/FILLING MACHINE AND METHOD FOR PRODUCING CONTENT-FILLED FILM PACKAGING BAG

TECHNICAL FIELD

The present invention relates to a vertical bag-making/filling machine. Particularly, it relates to a vertical bag-making/filling machine performing full-filling which fills the bag with contents so that air does not remain.

BACKGROUND ART

A vertical bag-making/filling machine which manufactures a packaging bag in which liquid-state or paste-state contents are filled is known.

In this vertical bag-making/filling machine, a cylindrical film suspended in a vertical direction (perpendicular direction) is heat-welded by a sealing-off unit over the whole region in a transverse direction.

Subsequently, contents are supplied into the film and then, the film is fed at a constant pitch in the vertical direction and heat-welded by the sealing-off unit over the whole region in the transverse direction.

Lastly, the heat-welded portion is cut off, and the package portion enclosing the contents is separated. As described above, the film packaging bag containing the contents can be obtained.

In the vertical bag-making/filling machine, an art for filling (full-filling) the inside of the film packaging bag so that the inside of the film packaging bag is filled with the contents has been developed. By eliminating air left in the bag, quantitativity of the contents is improved, and decay of the contents or the like can be prevented.

Patent Document 1 describes a vertical bag-making/filling machine comprising a pair of ironing rollers.

The squeezing rollers sandwich the cylindrical film from outer sides and flatten it at a position where the contents are filled and divide the contents into an upper part and a lower part. Then, the film is fed downward in a state where the squeezing rollers are closed, and a portion where the films are in close contact is heat-welded. As a result, the quantitativity is improved, and the film packaging bag in which air is not mixed is obtained.

Patent Document 2 describes a filling packaging machine comprising a pair of squeezing rollers and a pair of shaping plates.

The shaping plates sandwich the cylindrical film from the outer sides at the position where the contents are filled so as to regulate swelling of the film packaging bag. Since the shaping plates make the shape of the film packaging bag constant, quantitativity of the contents is improved.

PRIOR ART DOCUMENTS

Patent Documents

Patent Document 1: Japanese Patent Laid-Open No. 2003-081207

Patent Document 2: Japanese Patent Laid-Open No. 2011-235942

SUMMARY OF INVENTION

Problem to be Solved

However, Patent Documents 1 and 2 have the following problems.

When the film packaging bag is fully filled with the contents, the film packaging bag is swollen and the film is brought into a tense state. If the film is flattened by the squeezing rollers in such a state, the film is wrinkled. Thus, if it is sealed transversely as it is, there is a problem that the contents leak out from the wrinkle.

Even if the shaping plates are used as in Patent Document 2, since the film is flattened by the squeezing rollers, the film is wrinkled.

Particularly, when an inflation film is used, since the film is soft, the wrinkles can be generated easily.

The present invention has an object to provide a vertical bag-making/filling machine which can improve quantitativity of the contents and achieve a film packaging bag in which air is not mixed.

Solution to Problem

A first embodiment of the vertical bag-making/filling machine of the present invention is characterized by comprising: a film-feeding unit which intermittently feeds a film formed into a tubular shape downward; a nozzle extending downward along a length direction of the film and supplying contents into the film; a sealing-off unit arranged below a lower end of the nozzle and forming a bag body by heat-sealing the film in a transverse direction; a lower shaping unit arranged below the sealing-off unit and regulating swelling of the film when the contents are supplied from the nozzle; an upper shaping unit arranged above the sealing-off unit and regulating the swelling of the film when the contents are supplied from the nozzle; and a separating unit for separating the bag body fully filled with the contents by cutting the transverse seal formed by the sealing-off unit.

A second embodiment of the vertical bag-making/filling machine of the present invention is characterized in that, in the first embodiment, each of the lower shaping unit and the upper shaping unit comprises a pair of endless track belts compressing the film such that it can move downward.

A third embodiment of the vertical bag-making/filling machine of the present invention is characterized in that, in the first embodiment or second embodiment, the upper shaping unit has a regulating thickness smaller than that of the lower shaping unit.

A fourth embodiment of the vertical bag-making/filling machine of the present invention is characterized in that, in any one of the first to third embodiments, the upper shaping unit is arranged at a position where the upper shaping unit contains a lower end of the nozzle.

A fifth embodiment of the vertical bag-making/filling machine of the present invention is characterized in that, in any one of the first to fourth embodiments, the upper shaping unit is divided and arranged on both sides in the transverse direction with sandwiching the nozzle.

A sixth embodiment of the vertical bag-making/filling machine of the present invention is characterized by comprising, in any one of the first to fifth embodiments, a film clamp arranged immediately above the sealing-off unit and grasping the film over the transverse direction flatly and dividing the contents filled in the film to an upper part and a lower part.

A seventh embodiment of the vertical bag-making/filling machine of the present invention is characterized by comprising, in any one of the first to fifth embodiments, a seal cooling unit arranged at the same position as the sealing-off unit and cooling the seal formed by the sealing-off unit.

An eighth embodiment of the vertical bag-making/filling machine of the present invention is characterized in that, in any one of the first to seventh embodiments, the film is an inflation film which is compressed to flat and inside surfaces are in close contact with each other, and the vertical bag-making/filling machine comprises: a side edge cutter for cutting a side edge of the film along a longitudinal direction; and a sealing and bag-making unit arranged above the lower end of the nozzle, heat-sealing the side edge of the film along the longitudinal direction and heat-sealing the film in the traverse direction excluding an insertion portion of the nozzle so as to form a plurality of incomplete bag bodies communicating with each other.

A ninth embodiment of the vertical bag-making/filling machine of the present invention is characterized in that, in the eighth embodiment, the sealing and bag-making unit heat-seals four corners of the bag body in a diagonal direction.

A tenth embodiment of the vertical bag-making/filling machine of the present invention is characterized by comprising, in the ninth embodiment, a corner cutter for cutting off the four corners.

A first embodiment of a method for producing a content-filled film packaging bag of the present invention is characterized by comprising: a first sealing-off step of heat-sealing a tubular film arranged to be feedable downward by a sealing-off unit so as to form a bag body; a step of supplying contents into the film from a nozzle arranged above the sealing-off unit and extending downward along a length direction of the film; a step of intermittently feeding the film downward by a film-feeding unit; a lower-side shaping step for regulating swelling of the film by compressing the film by a lower shaping unit arranged below the sealing-off unit; an upper-side shaping step for regulating the swelling of the film by compressing the film by an upper shaping unit arranged above the sealing-off unit; a second sealing-off step of forming the bag body fully filled with the contents by heat-sealing the film in the traverse direction by the sealing-off unit; and a separating step of separating the bag body fully filled with the contents by cutting off the traverse seal formed by the sealing-off unit by a separating unit.

A second embodiment of the method for producing the content-filled film packaging bag containing the contents of the present invention is characterized in that, in the first embodiment, the second sealing-off step also serves as the first sealing-off step.

A third embodiment of the method for producing the content-filled film packaging bag of the present invention is characterized in that, in the first or second embodiment, each of the lower shaping unit and the upper shaping unit has a pair of endless track belts and compresses the film such that it can move downward.

A fourth embodiment of the method for producing the content-filled film packaging bag of the present invention is characterized in that, in any one of the first to third embodiments, the upper shaping unit has a regulation thickness smaller than that of the lower shaping unit.

A fifth embodiment of the method for producing the content-filled film packaging bag of the present invention is characterized by comprising, in any one of the first to fourth embodiments, at the same time as the second sealing-off step, a step of grasping the film and dividing the contents filled in the film into an upper part and a lower part by a film clamp arranged immediately above the sealing-off unit flatly over the transverse direction.

A sixth embodiment of the method for producing the content-filled film packaging bag of the present invention is characterized by comprising, in any one of the first to fifth embodiments, immediately before the separating step, a step of cooling the transverse seal formed by the sealing-off unit by a seal cooling unit arranged at the same position as the sealing-off unit.

A seventh embodiment of the method for producing the content-filled film packaging bag of the present invention is characterized in that, in any one of the first to sixth embodiments, the film is an inflation film which is compressed to flat and inside surfaces being in close contact with each other, and the method comprises prior to the first sealing-off step, a step of cutting off a side edge of the film along a longitudinal direction by a side edge cutter, and a step of forming an incomplete bag body by heat-sealing the side edge of the film along the longitudinal direction and heat-sealing the film in the traverse direction excluding an insertion portion of the nozzle by a sealing and bag-making unit arranged above the lower end of the nozzle.

An eighth embodiment of the method for producing the content-filled film packaging bag of the present invention is characterized in that, in the seventh embodiment, the sealing and bag-making unit heat-seals four corners of the bag body in a diagonal direction.

A ninth embodiment of the method for producing the content-filled film packaging bag of the present invention is characterized by comprising, in the eighth embodiment, a step of cutting off the four corners by a corner cutter.

Effects of Invention

According to the present invention, the quantitativity of the contents is improved, and the film packaging bag in which air is not left can be obtained.

DESCRIPTION OF EMBODIMENTS

A vertical bag-making/filling machine 1 and a method for producing a content-filled film packaging bag G according to an embodiment of the present invention will be described below.

[Vertical Bag-Making/Filling Machine 1]

Figure 1:
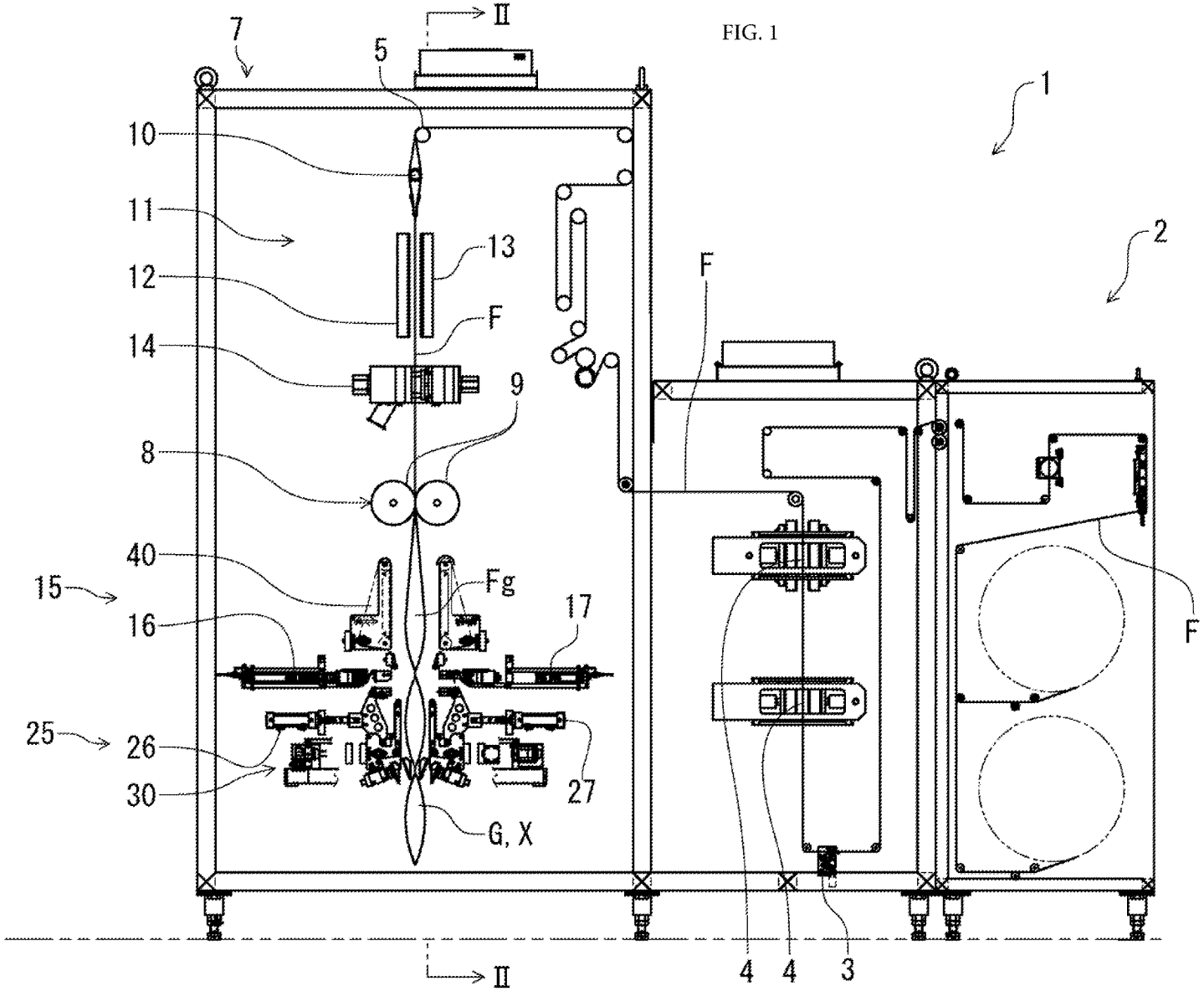
FIG. 1 is a vertical sectional view illustrating a vertical bag-making/filling machine 1 according to an embodiment of the present invention.

FIG. 1 is a vertical sectional view illustrating a vertical bag-making/filling machine 1 according to the embodiment of the present invention.

Figure 2:
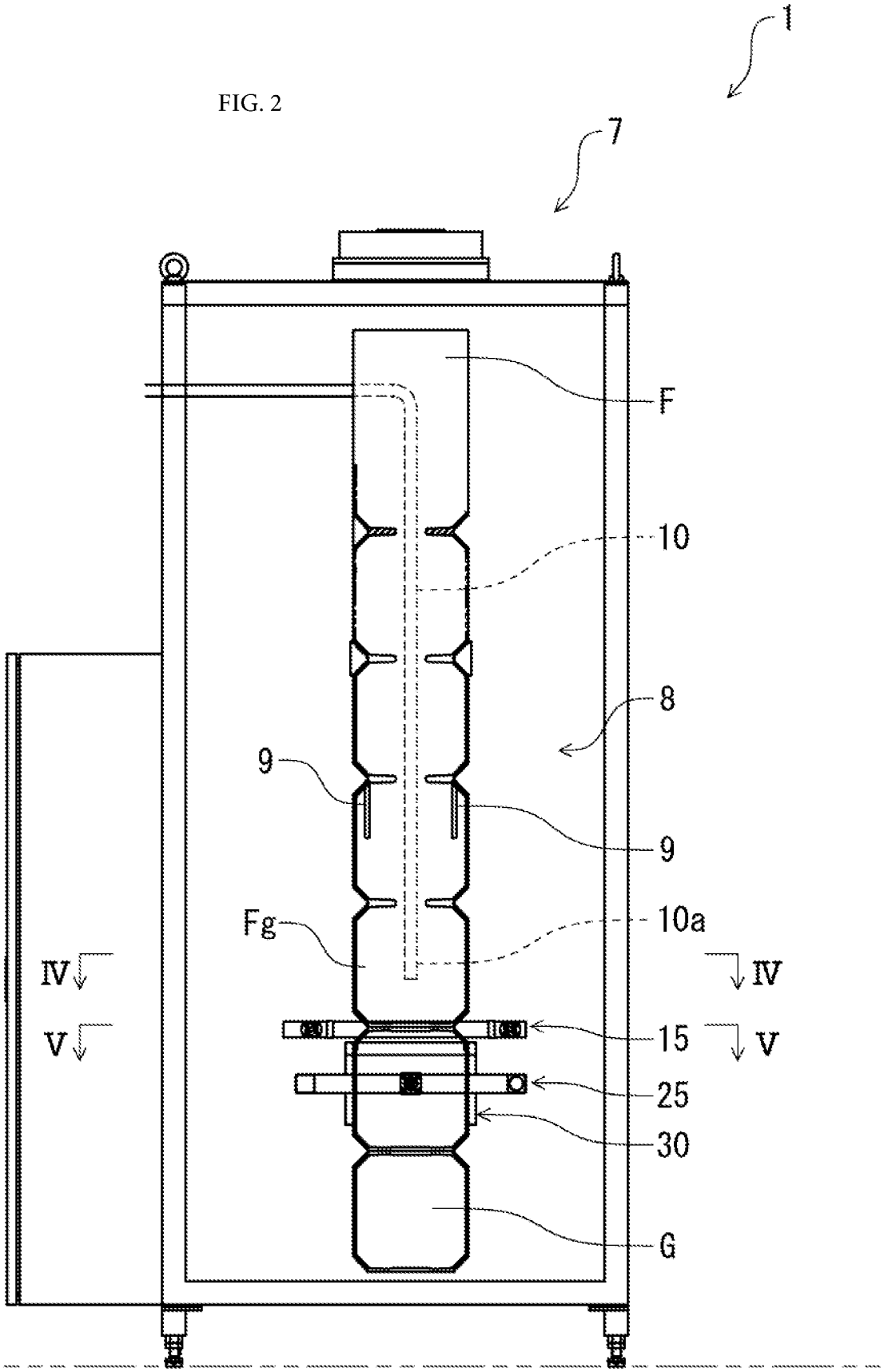
FIG. 2 is a sectional view illustrating a bag-making/filling unit 7 (II-II sectional view).

FIG. 2 is a sectional view illustrating a bag-making/filling unit 7 (II-II sectional view).

Figure 3:
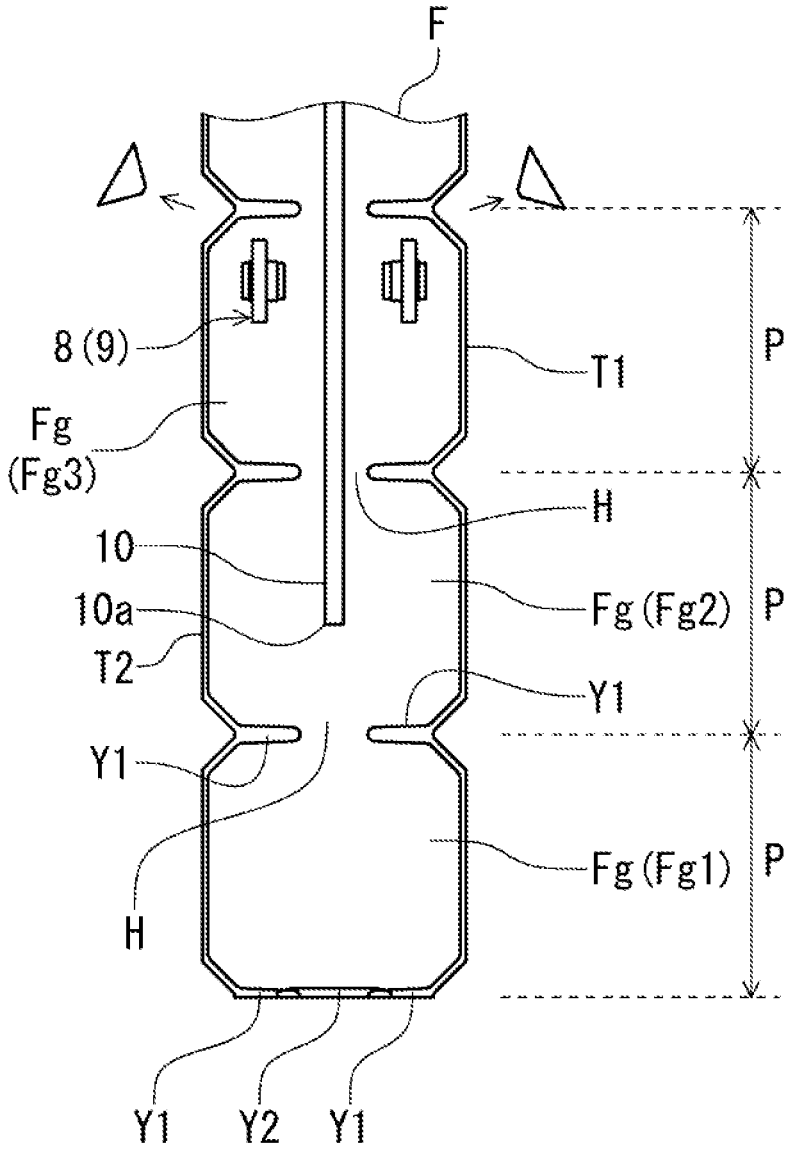
FIG. 3 is a view illustrating a bag body Fg formed in a film F.

FIG. 3 is a view illustrating a bag body Fg formed in a film F.

The vertical bag-making/filling machine 1 manufactures a film packaging bag (bag body) G in which liquid-state or paste-state contents X are fully filled by using a film F shaped into a tubular shape.

As the film F, the one which is shaped into the tubular shape by an inflation method and immediately after that, folded flatly so that inside surfaces are brought into close contact with each other is used. The film F is referred to as an inflation film.

The contents X are liquid-state or paste-state beverage or food.

The film F is filled with the contents X while intermittently being fed downward in a perpendicular direction.

The film packaging bag G is fully filled so that its inside is filled with the contents X. The film packaging bag G is fully filled with the contents X so that air is not left in the bag.

A direction along a feeding direction of the film F is referred to as a longitudinal direction. Particularly the longitudinal direction (perpendicular direction) of the film F in the bag-making/filling unit 7 is also referred to as a vertical direction or an up-and-down direction.

A width direction of the film F is referred to as a transverse direction.

A direction in which the film F is swollen is referred to as a thickness direction.

As illustrated in FIG. 1, the vertical bag-making/filling machine 1 comprises a film supply unit 2, the bag-making/filling unit 7 and the like.

The film supply unit 2 comprises a plurality of rollers and supplies the film F toward the bag-making/filling unit 7.

The film F is wound into a roll state and pivotally supported by the film supply unit 2. An end of the film F is open.

The film supply unit 2 feeds out the film F wound into a roll state and sends it out via the plurality of rollers so that slackening or meandering does not occur.

The film supply unit 2 comprises a side edge cutter 3 for cutting off the film, a pair of vertical seal units 4, and a guide roller 5.

The side edge cutter 3 is mounted in the middle of a path of the film F and cuts off the side edges (both side edges) of the film F in the transverse direction. With feeding of the film F, the both side edges of the film F is cut off along the longitudinal direction by the side edge cutter 3 and opened.

Since the film F is obtained by flatten the inflation film, both side edges are made thicker by folding. When this film F is to be wound into a roll state, it is wound with the end portions shifted so as to be wound stably.

When the film F wound into a roll state as above is fed out, meandering of the film F inevitably occurs.

Thus, even if a first side edge Fa of the film F is cut by the side edge cutter 3, the film F after the cutting has uneven width. Therefore, a size of the film packaging bag G is also varied, and quantitativity of the contents X is lost.

Thus, in the film supply unit 2, the both side edges (the first side edge Fa and a second side edge Fb) of the film F are cut off by the side edge cutter 3. Even if the film F is fed while meandering, the film F can be cut off having a constant width. Therefore, the size of the film packaging bag G is made constant, and quantitativity of the contents X can be promoted.

The vertical seal units (sealing and bag-making unit) 4 are arranged above the side edge cutter 3 (on a downstream side of the path of the film F). Each of the vertical seal units 4 heat-seals (heat-welds) the first side edge Fa of the film F along the longitudinal direction.

A vertical seal T1 is continuously formed on the first side edge Fa of the film F without a gap by the pair of vertical seal units 4.

As a result, the film F is brought into a state where the second side edge Fb is cut open.

The film supply unit 2 supplies the film F with the second side edge Fb open to the guide roller 5.

The guide roller 5 is arranged above the bag-making/filling unit 7 (on an upstream side of the path of the film F) and changes the feeding direction of the film F to downward in the perpendicular direction.

The bag-making/filling unit 7 forms the bag body Fg on the film F and fills contents X while feeding the film F in the vertical direction. And the bag-making/filling unit 7 separates this bag body Fg and manufactures the film packaging bag G (film packaging bag G containing the contents) fully filled with the contents X.

The bag-making/filling unit 7 includes a film-feeding unit 8, a nozzle 10, a Y-shaped sealing and bag-making unit 11, a corner cutter 14 and the like.

The film-feeding unit 8 intermittently feeds the film F downward at a predetermined pitch P.

The film-feeding unit 8 has four rollers 9 holding the film F from both sides. A pair of rollers 9 holding the film F from both sides is arranged on both sides of the film F in the transverse direction, respectively. The film-feeding unit 8 feeds out the film F downward by intermittently rotating the four rollers 9.

The predetermined pitch P is matched with a length of the bag body Fg in the vertical direction which will be described later.

The nozzle 10 discharges the liquid-state or paste-state contents X into the film F.

The nozzle 10 is inserted into the film F from the second side edge Fb of the film F immediately below the guide roller 5. The nozzle 10 is bent downward at a center in the transverse direction of the film F and extends downward. The nozzle 10 is passed (inserted) among the four rollers 9 of the film-feeding unit 8 and further extends downward.

The nozzle 10 discharges drinking water, for example, as the contents X.

The Y-shaped sealing and bag-making unit (sealing and bag-making unit) 11 heat-seals (heat-welding) the film F over the transverse direction excluding an insertion portion of the nozzle 10.

At the same time, the Y-shaped sealing and bag-making unit 11 heat-seals (heat-welding) the second side edge Fb of the film F along the vertical direction.

As a result, the Y-shaped sealing and bag-making unit 11 forms an incomplete bag body Fg in the film F.

The Y-shaped sealing and bag-making unit 11 is arranged between an insertion position of the nozzle 10 and the film-feeding unit 8.

The Y-shaped sealing and bag-making unit 11 has a pair of heater bars 12 and 13 opposingly arranged so as to sandwich the film F in a thickness direction. A heater (not shown) is built in the heater bar 12.

The heater bars 12 and 13 have a shape each not interfering with the nozzle 10 when they sandwich the film F.

The heater bars 12 and 13 are opposingly moved by a driving source (not shown) and pressurize and heat the film F. As a result, the film F is heat-sealed.

The Y-shaped sealing and bag-making unit 11 forms a pair of transverse seals Y1 crossing the film F in the transverse direction.

As illustrated in FIG. 3, each of the transverse seals Y1 has such a shape that a Y-shape is fallen sidewise. As a result, a triangular non-welded portion is formed on the both side edges of the film F.

The non-welded portion (opening portion H) is formed on the insertion portion (between the pair of transverse seals Y1) of the nozzle 10.

A width of a portion extending in the transverse direction (length in the vertical direction) in the transverse seal Y1 is approximately twice of the width of the vertical seal T1 (length in the transverse direction). In the transverse seal Y1, a width of a portion extending in a diagonal direction is the same as the width of the vertical seal T1.

The Y-shaped sealing and bag-making unit 11 forms a vertical seal T2 along the vertical direction on the second side edge Fb of the film F. The width of the vertical seal T2 (length in the transverse direction) is the same as the width of the vertical seal T1 (length in the transverse direction).

The Y-shaped sealing and bag-making unit 11 is operated when the intermittent feeding of the film F by the film-feeding unit 8 is stopped. After the operation of the Y-shaped sealing and bag-making unit 11, the film-feeding unit 8 feeds the film F downward, and when the film F is stopped, the Y-shaped sealing and bag-making unit 11 is operated again.

Therefore, a pair of the transverse seals Y1 is formed in the vertical direction at a constant interval on the film F, and the vertical seal T2 is continuously formed without a gap. In the film F, a plurality of the bag bodies Fg is continuously formed (defined).

This bag body Fg is an octagonal bag body with four corners (corner parts) sealed diagonally. The plurality of bag bodies Fg has opening portions H between the pair of transverse seals Y1, respectively, and incomplete plural bag bodies communicating with each other through this opening portion H.

The corner cutter 14 cuts off the four corners of the bag body Fg. It cuts off a portion (triangular non-welded portion) excluding the transverse seals Y1 in the both side edges of the film F.

The corner cutter 14 is operated when the intermittent feeding of the film F by the film-feeding unit 8 is stopped.

Therefore, a plurality of octagonal bag bodies Fg is continuously formed in the film F.

The bag-making/filling unit 7 comprises a sealing-off unit 15, a film clamp 21, a cooling and cutting unit 25 and the like below the film-feeding unit 8.

Figure 5:
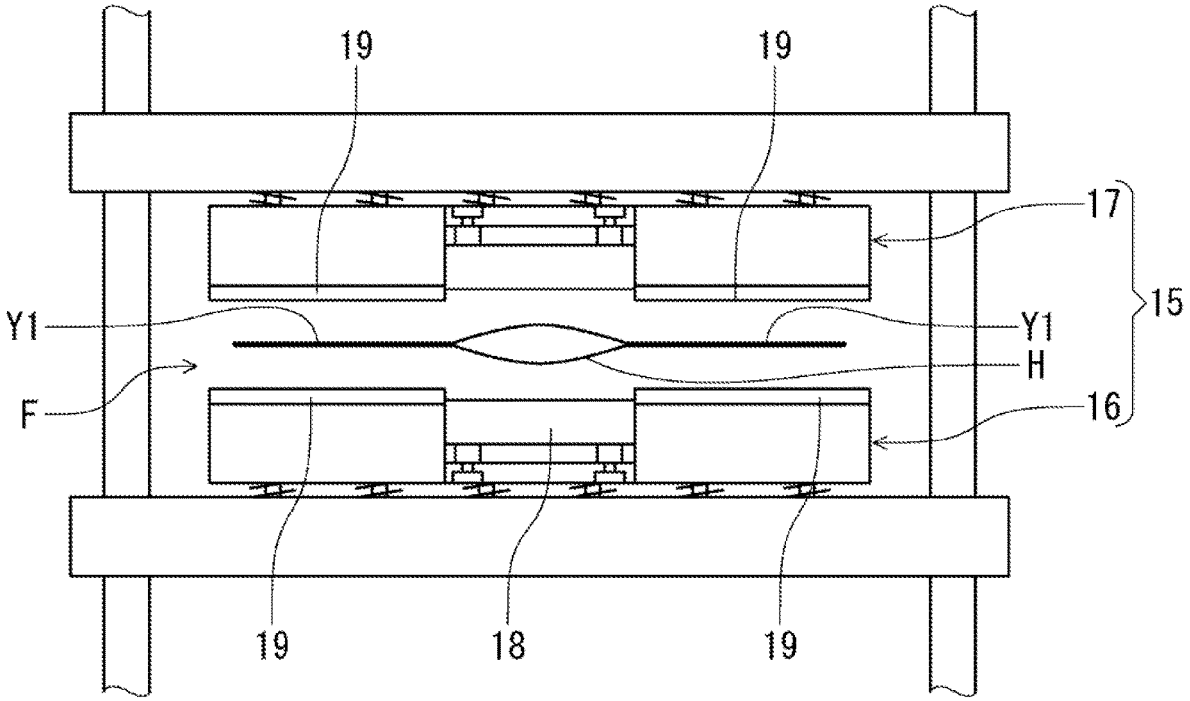
FIG. 5 is a sectional view illustrating a sealing-off unit 15 (V-V sectional view).

FIG. 5 is a sectional view illustrating the sealing-off unit 15 (V-V sectional view).

The sealing-off unit 15 forms a complete bag body Fg out of the incomplete bag body Fg. The sealing-off unit 15 heatseals the pair of transverse seals Y1 to each other. The sealing-off unit 15 heat-seals the non-welded portion (opening portion H) into which the nozzle 10 has been inserted.

As a result, the incomplete bag body Fg is formed into the complete bag body Fg.

The sealing-off unit 15 has a pair of heater bars 16 and 17 opposingly arranged so as to sandwich the film F in a thickness direction. A heater 18 is built in at a center in the transverse direction of the heater bar 16.

A wrinkle removing unit 19 is provided on the heater bars 16 and 17. The wrinkle removing unit 19 is arranged on the both end sides of the heater bars 16 and 17 in the transverse direction, respectively.

The heater bars 16 and 17 are opposingly moved by the driving source (not shown) and pressurize and heat the film F.

First, the wrinkle removing unit 19 is brought into contact with the both sides in the transverse direction of the film F and pulls the film F to outer sides in the traverse direction. As a result, wrinkles generated on the film F are spread.

Subsequently, the heater 18 is brought into contact with the center of the film F in the transverse direction and heat-seals it. A transverse seal Y2 is formed between the pair of transverse seals Y1 and connects the pair of transverse seals Y1.

The sealing-off unit 15 is operated when the intermittent feeding of the film F by the film-feeding unit 8 is stopped.

After the operation of the sealing-off unit 15, the film-feeding unit 8 feeds the film F downward, and when the film F is stopped, the sealing-off unit 15 is operated again.

Therefore, the complete bag bodies Fg (the film packaging bags G in which the contents X are sealed) are continuously formed in the film F.

The film clamp 21 is arranged immediately above the sealing-off unit 15 and assists the heat-sealing by the sealing-off unit 15.

The film clamp 21 has a pair of clamp bars 22 and 23 opposingly arranged so as to sandwich the film F in the thickness direction and pressurizes and holds the film F from both sides over the whole region in the transverse direction.

The clamp bars 22 and 23 are opposingly moved by the driving source (not shown) and pressurize the film F over the whole region in the transverse direction. The film clamp 21 holds a bottom part of the bag body Fg from both sides. It pressurizes and holds the bottom part from both sides at a position immediately above the pair of transverse seals Y1.

As a result, the contents X cannot be moved in the up-and-down direction through the opening portion H of the bag body Fg. Therefore, the opening portion H is brought into close contact, and heat-sealing by the sealing-off unit 15 is made easy.

The film clamp 21 continuously pressurizes and holds the film F from both sides even after the sealing-off unit 15 heat-seals the opening portion H. It supports a weight of the contents X present above the transverse seals Y1 and prevents the transverse seal Y2 formed on the opening portion H from being peeled off.

The film clamp 21 is operated substantially at the same time as the sealing-off unit 15. It is operated when the intermittent feeding of the film F by the film-feeding unit 8 is stopped.

The cooling and cutting unit (separating unit, seal cooling unit) 25 separates the film packaging bag G in which the contents X are sealed from the film F.

The cooling and cutting unit 25 cools the transverse seal Y2 prior to the cutting of the film F and rapidly solidifies this transverse seal Y2.

The cooling and cutting unit 25 is arranged at substantially the same position as the sealing-off unit 15.

The cooling and cutting unit 25 has a pair of cutting cooling bars 26 and 27 opposingly arranged so as to sandwich the film F in the thickness direction. A cutter and a cooler (none of them is shown) are built in the cutting cooling bar 26.

The cooling cutting bars 26 and 27 are opposingly moved by the driving source (not shown) and pressurize and cool the film F. As a result, the transverse seal Y2 is completely solidified.

Immediately after that, the cooling and cutting unit 25 cuts off the film F. The cooling and cutting unit 25 cuts off the transverse seals Y1 and Y2 over the whole region in the transverse direction.

Specifically, the cutter (not shown) of the cutting cooling bar 26 is moved toward the cutting cooling bar 27 and cuts the transverse seals Y1 and Y2 along the transverse direction.

As a result, the film packaging bag G in which the contents X are sealed is cut out from the lowermost end of the film F.

The cooling and cutting unit 25 is operated substantially at the same time as the sealing-off unit 15 and the film clamp 21. It is operated when the intermittent feeding of the film F by the film-feeding unit 8 is stopped.

Therefore, the film packaging bags G containing the contents are continuously cut out from the lowermost end of the film F.

The bag-making/filling unit 7 comprises a lower shaping unit 30, a bottom pressor 35, an upper shaping unit 40 and the like below the film-feeding unit 8.

The lower shaping unit 30 is arranged below the sealing-off unit 15 and the cooling and cutting unit 25 and supports a bag body Fg1 arranged at the lowermost end (first) of the film F from the thickness direction.

The lower shaping unit 30 regulates swelling of the bag body Fg1 arranged at the lowermost end when the contents X are supplied from the nozzle 10.

The lower shaping unit 30 has a pair of shaping belts 31 opposingly arranged so as to sandwich the film F in the thickness direction. The shaping belts 31 are composed of an endless track belt 32 circulating along the vertical direction of the film F and a plurality of rollers 33 circulatably supporting this endless track belt 32.

The pair of shaping belts 31 is opposingly moved by the driving source (not shown) and is stopped at a predetermined interval.

The film F is fed between the pair of shaping belts 31. And when the contents X are supplied from the nozzle 10 toward the bag body Fg1, the film F (bag body Fg1) is swollen and is brought into contact with the pair of shaping belts 31. Thus, the bag body Fg1 cannot be swollen in the thickness direction more than the interval of the pair of shaping belts 31.

At this time, since the lower shaping unit 30 has the pair of endless track belts 32, it holds the film F from both sides such that it can move downward. The lower shaping unit 30 can feed the film F (bag body Fg1) downward while regulating swelling of the film F when the bag body Fg1 is to be fully filled with the contents X.

The length of the shaping belt 31 in the vertical direction is the same as or slightly smaller than the length in the vertical direction of the bag body Fg1 formed in the film F. The length where the endless track belt 32 is in contact with the film F is the same as or slightly smaller than the length in the vertical direction of the bag body Fg1. The swelling of the bag body Fg1 can be sufficiently regulated by adjusting the interval between the pair of shaping belts 31.

The bottom pressor 35 is arranged immediately below the lower shaping unit 30 and supports the bag body Fg1 (film packaging bag G containing the contents) arranged at the lowermost end of the film F from below.

The bottom pressor 35 has a pair of support bars 36 opposingly arranged so as to sandwich the film F in the thickness direction. The pair of support bars 36 is opposingly moved by the driving source (not shown) and is stopped at an interval smaller than the lower shaping unit 30. As a result, the film F (bag body Fg1) fed to a space between the pair of shaping belts 31 is supported from below.

The upper shaping unit 40 is arranged above the sealing-off unit 15 and the cooling and cutting unit 25 and supports the bag body Fg1 arranged at the lowermost end of the film F and a bag body Fg2 arranged subsequent (second) to that from the thickness direction.

The upper shaping unit 40 regulates the swelling of the bag body Fg1 arranged at the lowermost end and the bag body Fg2 arranged subsequent to that when the contents X are supplied from the nozzle 10. The upper shaping unit 40 moves the air having entered into the bag body Fg upward so that it can escape from the bag body Fg easily.

The upper shaping unit 40 has a pair of shaping belts 41 opposingly arranged (fixedly arranged) by sandwiching the film F from the thickness direction.

Each of the shaping belts 41 is composed of an endless track belt 42 circulating along the vertical direction of the film F and a plurality of rollers 43 circulatably supporting this endless track belt 42.

Figure 4:
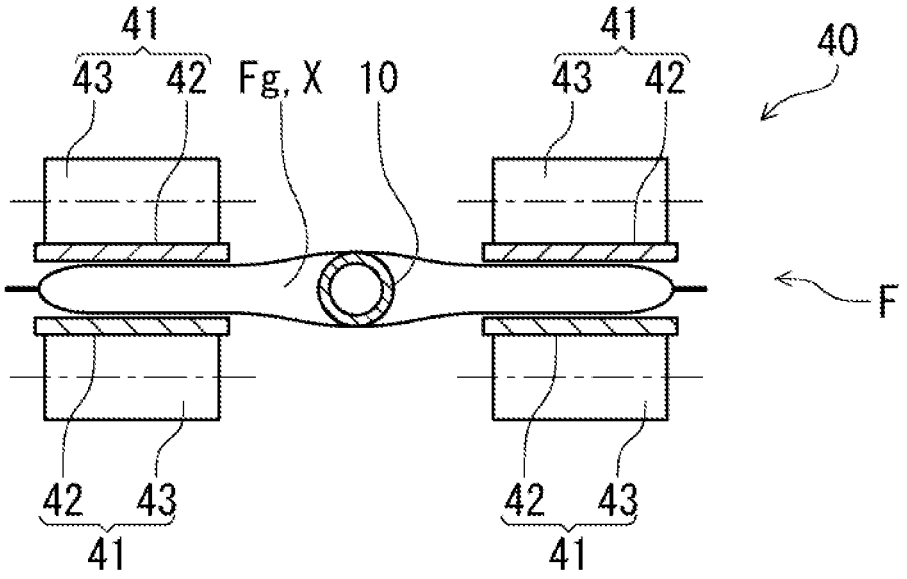
FIG. 4 is a sectional view illustrating an upper shaping unit 40 (IV-IV sectional view).

FIG. 4 is a sectional view illustrating the upper shaping unit 40 (IV-IV sectional view).

Each of the shaping belts 41 is divided into and arranged as two parts in the transverse direction. Each of the shaping belts 41 supports both end sides in the transverse direction excluding the center in the transverse direction of the film F.

The nozzle 10 is arranged between the pair of shaping belts 41. The nozzle 10 is arranged at the center of each of the shaping belts 41. The upper shaping unit 40 is arranged so as not to interfere with the nozzle 10 in the transverse direction and in the thickness direction.

The upper shaping unit 40 is arranged at a position where the upper shaping unit 40 contains a lower end 10*a* of the nozzle 10. The upper shaping unit 40 has its upper end positioned above the lower end 10*a* of the nozzle 10 and has its lower end positioned below the lower end 10*a* of the nozzle 10.

The pair of shaping belts 41 is arranged at a predetermined interval. Specifically, an interval between the pair of shaping belts 41 is set smaller than the interval between the pair of shaping belts 31. The upper shaping unit 40 has a regulation thickness (regulation dimension in the thickness direction) smaller than that of the lower shaping unit 30.

The pair of shaping belts 41 has the regulation thickness set smaller than an outer diameter of the nozzle 10. Since each of the shaping belts 41 is divided into the two parts in the transverse direction, the regulation thickness can be set smaller than the outer diameter of the nozzle 10.

The film F is fed to the space between this pair of shaping belts 41. Then, when the contents X are supplied from the nozzle 10 toward the bag body Fg, the film F (bag body Fg) is swollen and is brought into contact with the pair of shaping belts 41. Thus, the bag body Fg cannot be swollen in the thickness direction more than the interval of the pair of shaping belts 41.

At this time, since the upper shaping unit 40 has the pair of endless track belts 42, it holds the film F from both sides such that it can move downward. The upper shaping unit 40 can feed the film F (bag body Fg) downward while regulating the swelling of the film F when the bag body Fg is to be fully filled with the contents X.

The length of the shaping belt 41 in the vertical direction is longer than the length in the vertical direction of the shaping belt 31. Specifically, it is the same as or slightly longer than the length in the vertical direction of the bag body Fg formed in the film F. The length where the endless track belt 42 is in contact with the film F is the same as or slightly longer than the length in the vertical direction of the bag body Fg.

Since the upper shaping unit 40 has the small regulation thickness and the long regulation length (regulation dimension in the vertical direction) with respect to the film F (bag body Fg), the upper shaping unit 40 largely regulates the swelling of the bag body Fg. Thus, when the contents X are discharged from the nozzle 10, the contents X cannot be fully contained in the bag body Fg (Fg2) held from both sides by the upper shaping unit 40 and the contents X enter the bag body Fg (Fg3) above this bag body Fg (Fg2).

As a result, the air (air bubbles) having entered into the bag body Fg can be moved upward easily. The contents X are spread upward, a pressure (water pressure) of the contents X is increased, and the air bubbles can be moved upward easily. The air bubbles are joined to each other, and buoyancy is increased.

Therefore, even if the air (air bubbles) is discharged together with the contents X from the nozzle 10, this air escapes upward from the bag body Fg held from both sides by the upper shaping unit 40.

Since the pair of shaping belts 41 has the regulation thickness set smaller than the outer diameter of the nozzle 10, an amount of the contents X accommodated in the bag body Fg is largely regulated. Thus, the film F (bag body Fg) is prevented from being stretched downward by a weight of the contents X.

Therefore, the lower end (the pair of transverse seals Y1) of the bag body Fg is accurately positioned in the up-and-down direction with respect to the sealing-off unit 15 (between the heater bars 16 and 17). Thus, defective sealing of the transverse seal Y2 by the sealing-off unit 15 can be prevented.

[Method for Producing the Content-Filled Film Packaging Bag G]

Subsequently, a step of manufacturing the film packaging bag G containing the contents by using the vertical bag-making/filling machine 1 will be described.

Figure 6:
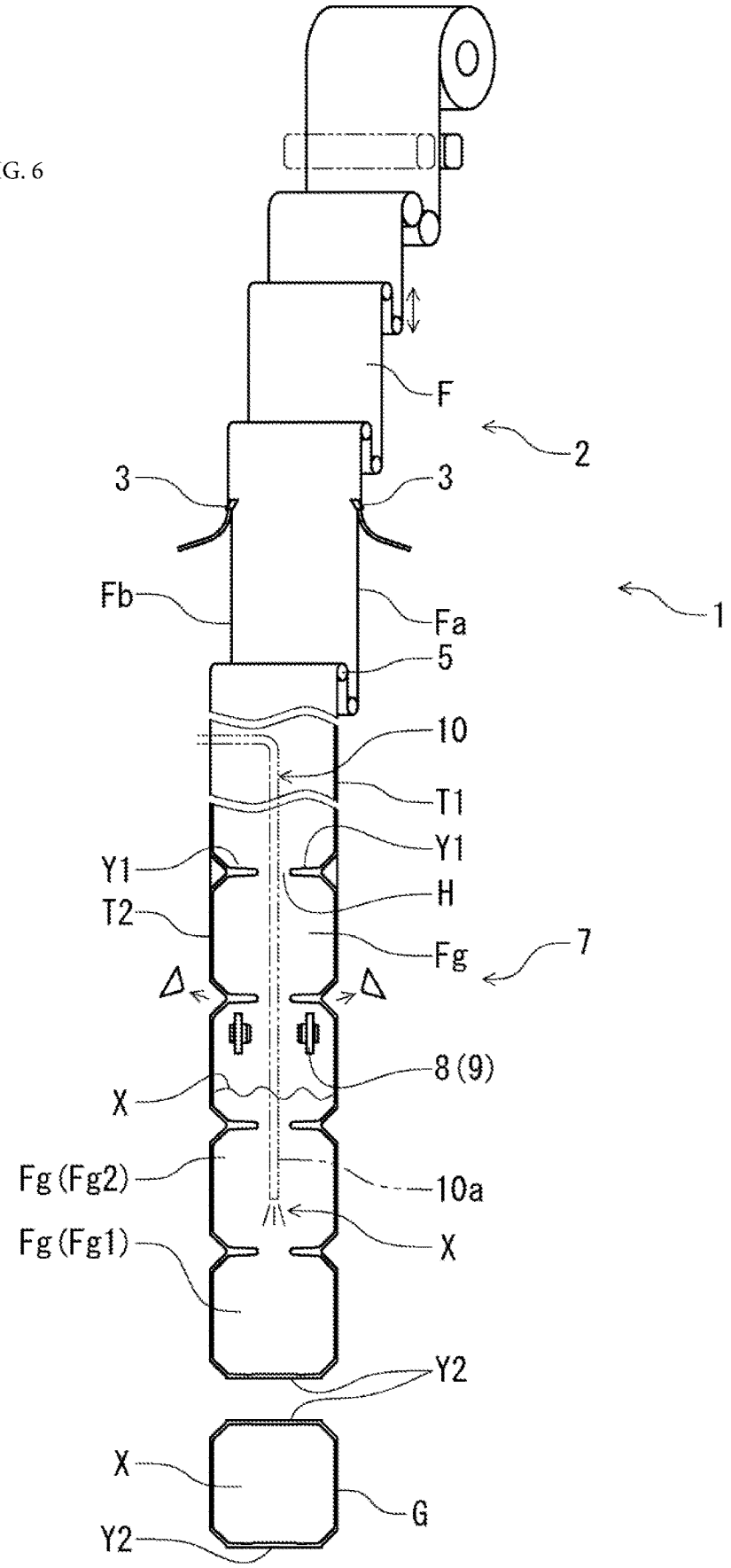
FIG. 6 is a view schematically illustrating an entire step of a method for producing a content-filled film packaging bag G.

FIG. 6 is a view schematically illustrating an entire step of the method for producing the content-filled film packaging bag G.

FIGS. 7 to 13 are views illustrating the method for producing the content-filled film packaging bag G in the order of steps.

Figure 7:
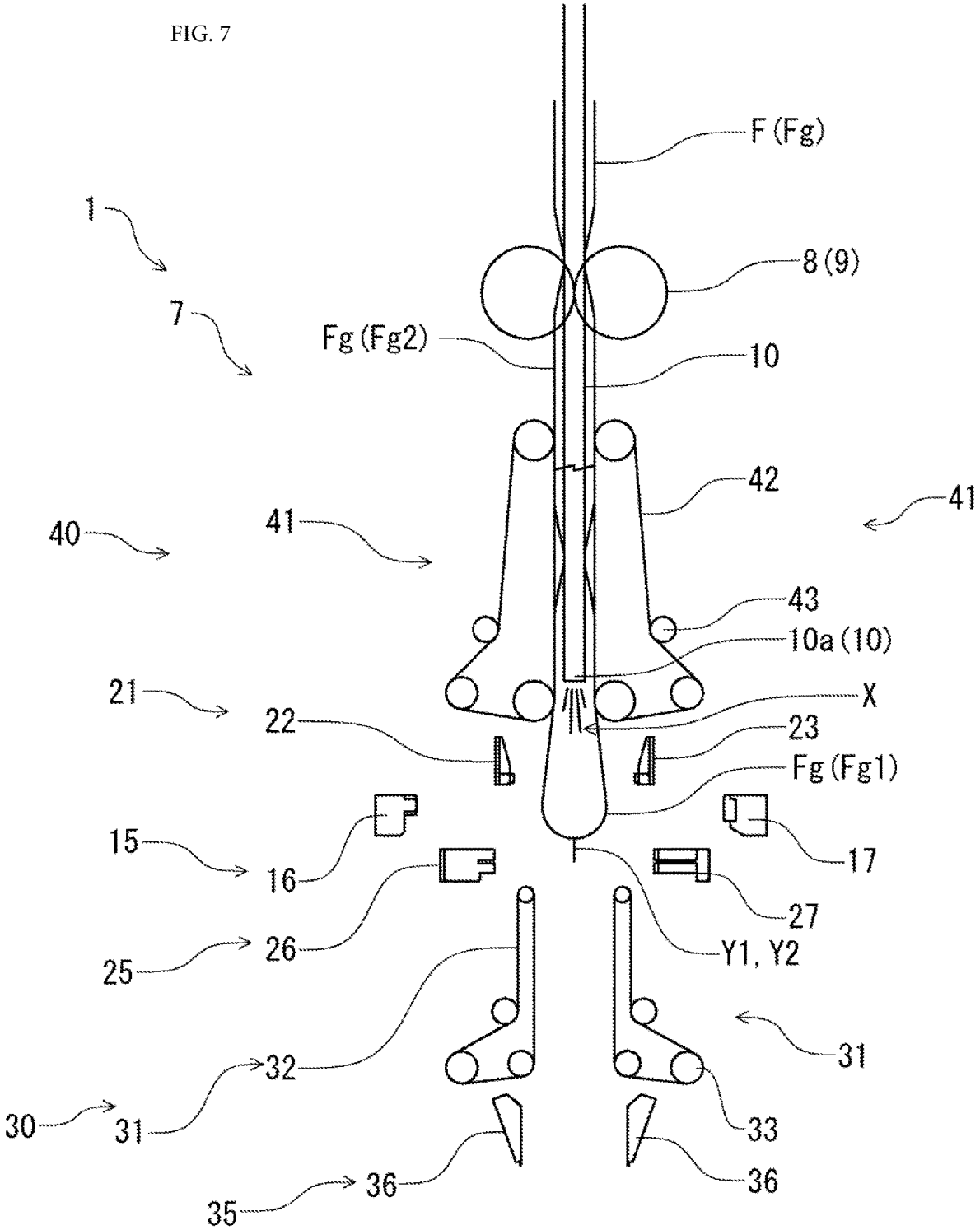
FIG. 7 is a view illustrating the method for producing the content-filled film packaging bag G and illustrates a content supply step S2.

Specifically, FIG. 7 is a view illustrating a content supply step S2.

Figure 8:
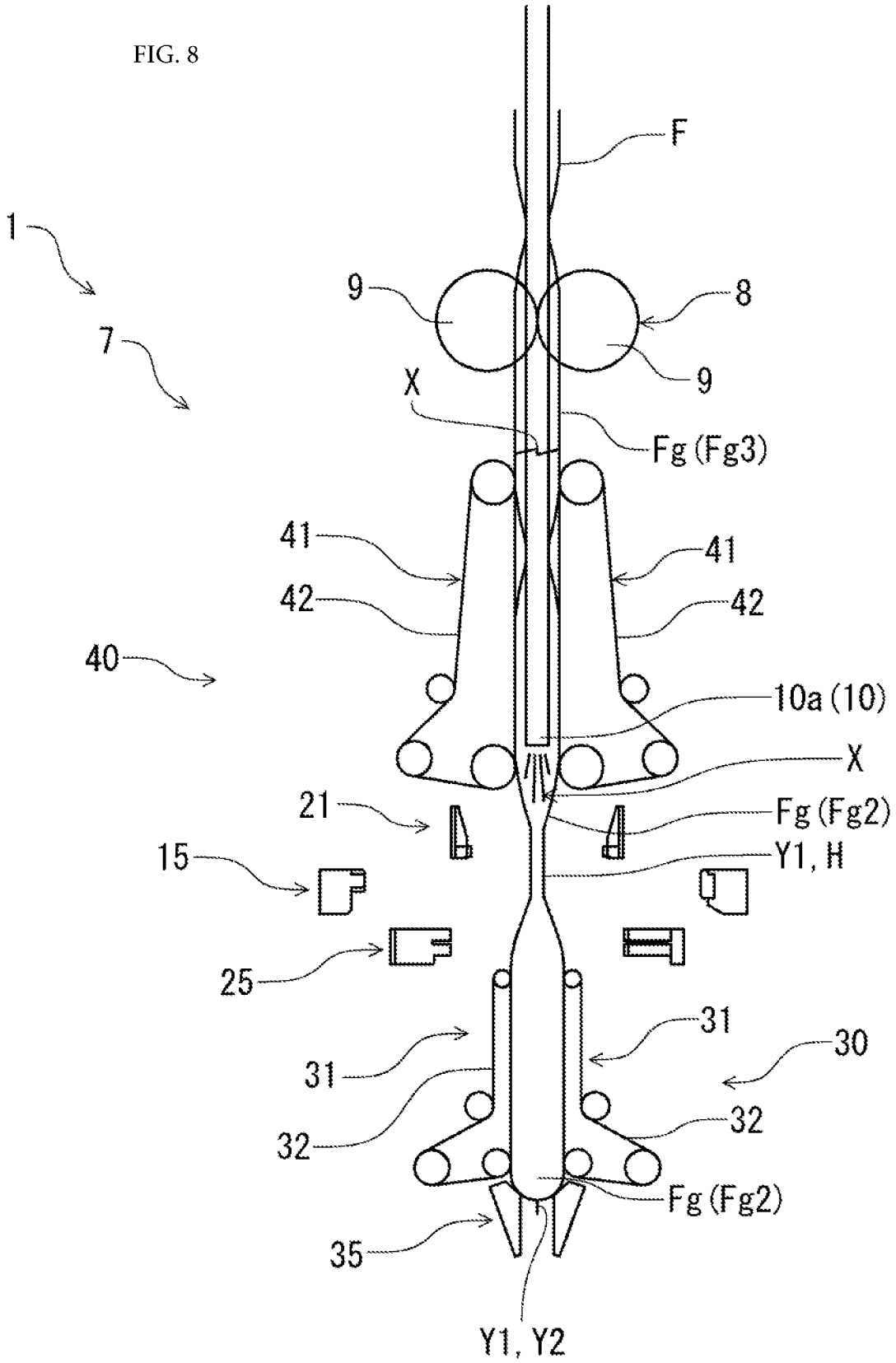
FIG. 8 is a view illustrating the method for producing the content-filled film packaging bag G and illustrates an intermittent feeding step S3, a lower-side shaping step S4, and an upper-side shaping step S5.

FIG. 8 is a view illustrating an intermittent feeding step S3, a lower-side shaping step S4, and an upper-side shaping step S5.

Figure 9:
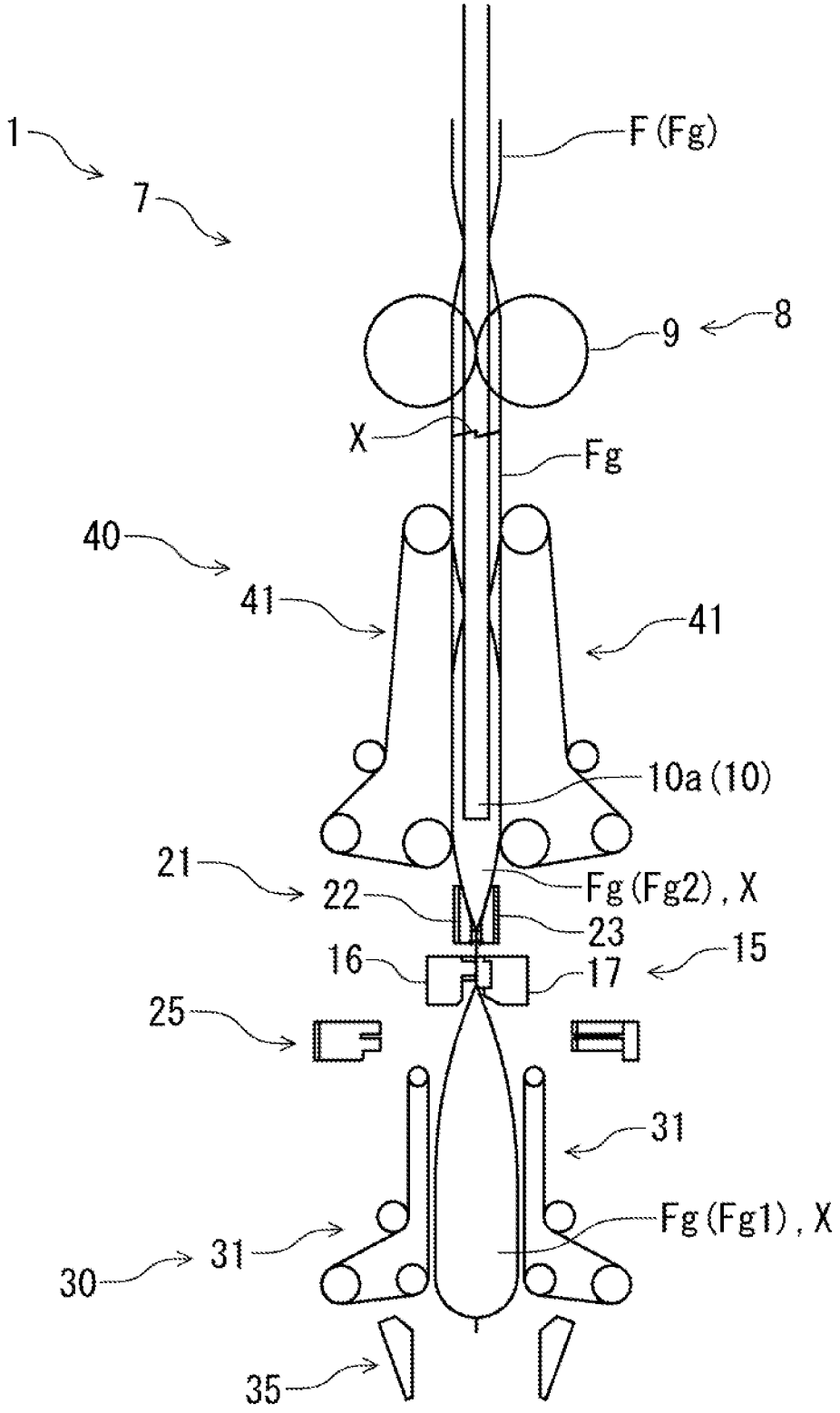
FIG. 9 is a view illustrating the method for producing the content-filled film packaging bag G and illustrates a second sealing-off step S6 and a clamping step S7.

FIG. 9 is a view illustrating a second sealing-off step S6 and a clamping step S7.

Figure 10:
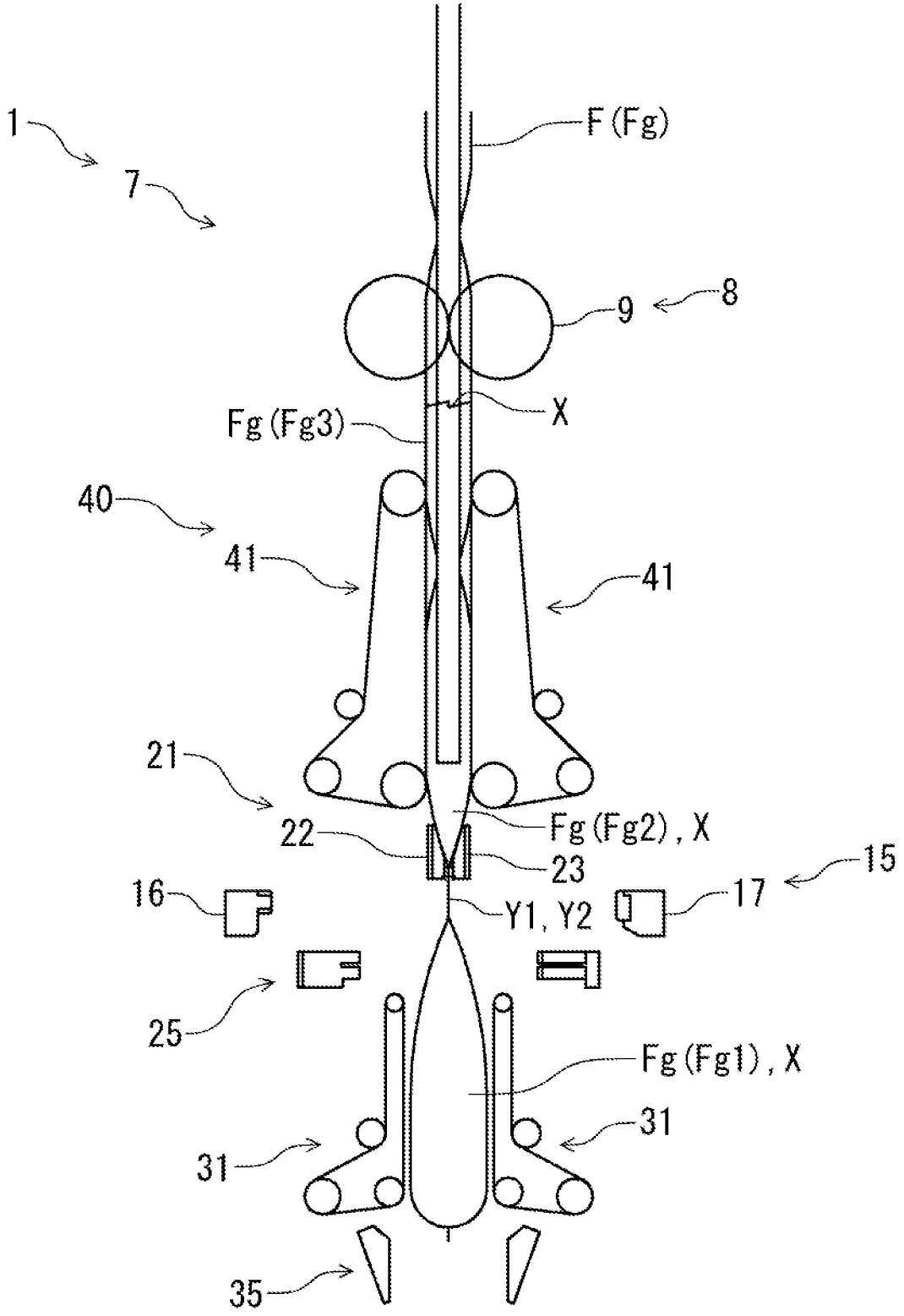
FIG. 10 is a view illustrating the method for producing the content-filled film packaging bag G and illustrates the clamping step S7.

FIG. 10 is a view illustrating the clamping step S7.

Figure 11:
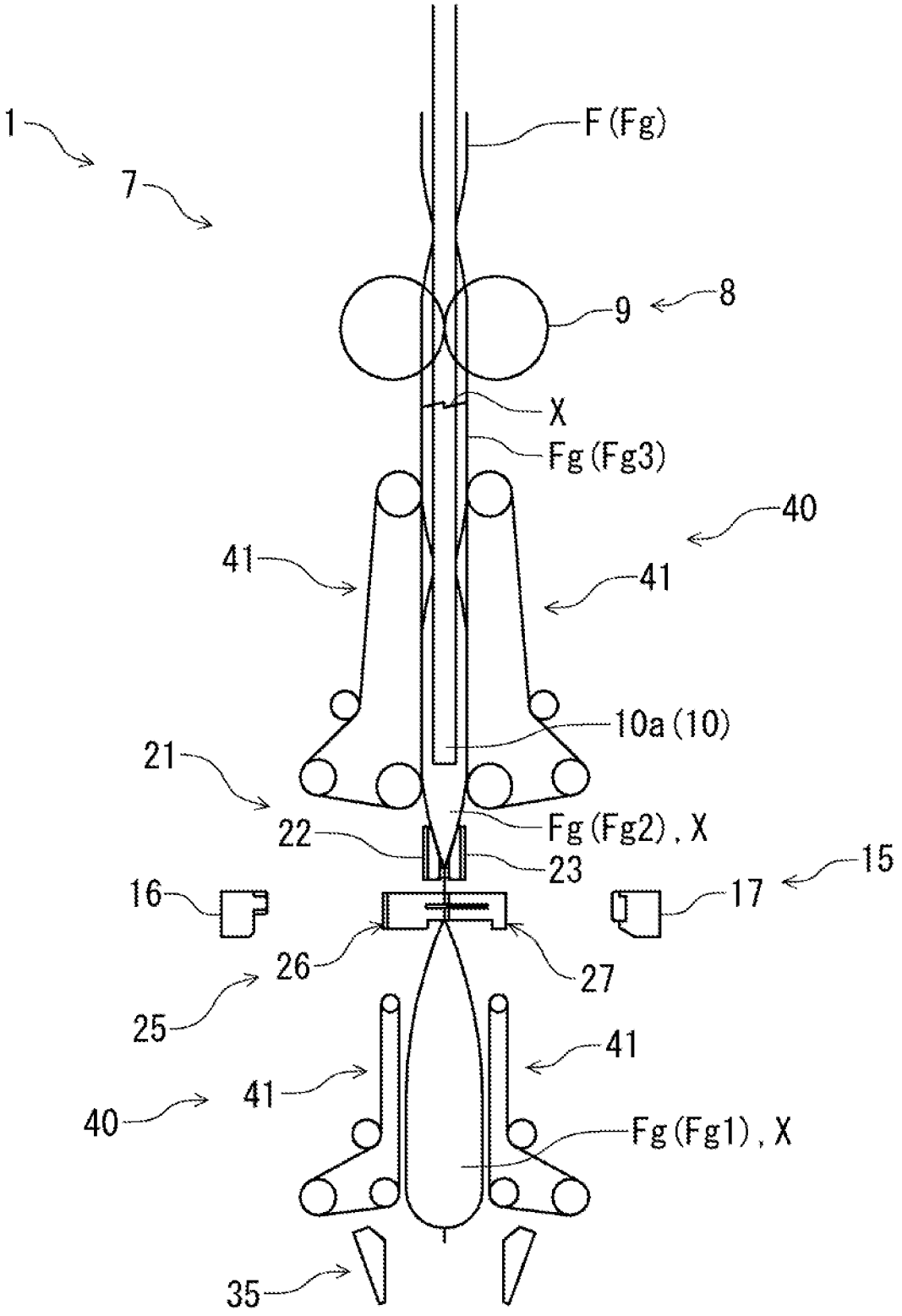
FIG. 11 is a view illustrating the method for producing the content-filled film packaging bag G and illustrates the clamping step S7 and a seal cooling step S8.
Figure 12:
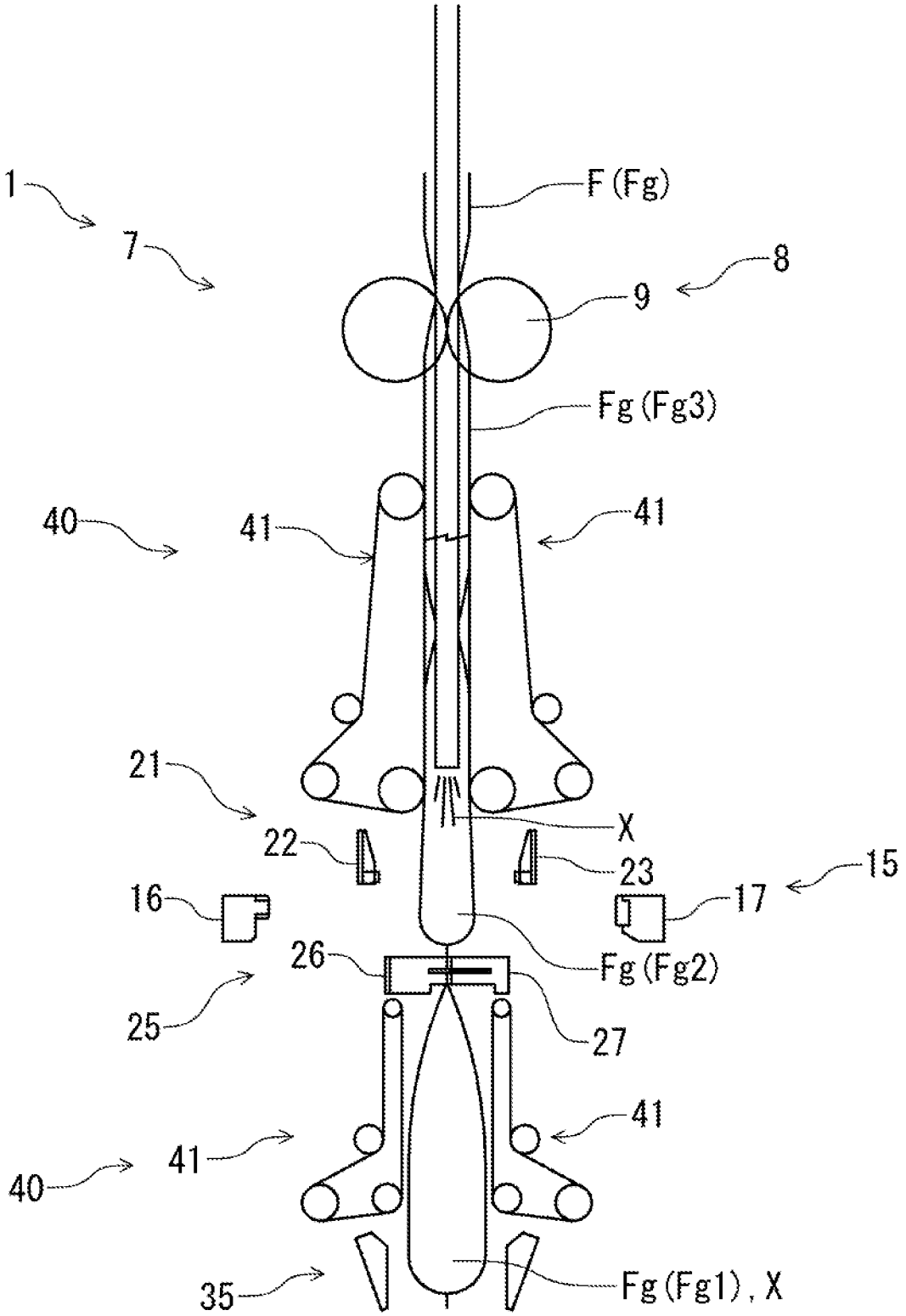
FIG. 12 is a view illustrating the method for producing the content-filled film packaging bag G and illustrates a separating step S9.

FIG. 11 is a view illustrating the clamping step S7 and a seal cooling step S8. FIG. 12 is a view illustrating a separating step S9.

Figure 13:
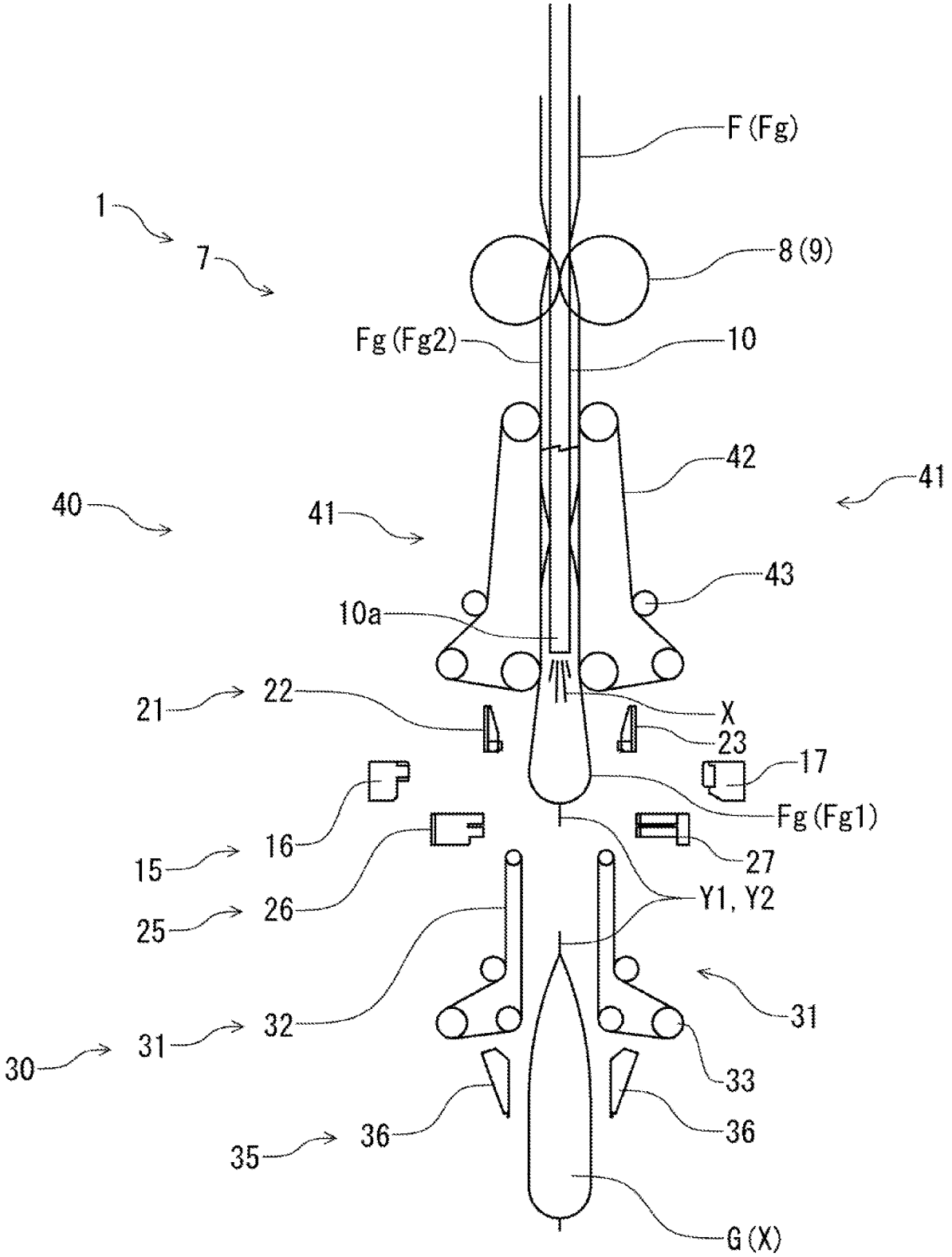
FIG. 13 is a view illustrating the method for producing the content-filled film packaging bag G and illustrates the separating step S9 and the content supply step S2.

FIG. 13 is a view illustrating the separating step S9 and the content supply step S2.

As illustrated in FIG. 6, the film F is held in the roll state in the film supply unit 2 and is intermittently fed out by the rotation of the film-feeding unit 8 of the bag-making/filling unit 7.

(Side Edge Cutting Step B1)

The film F has both side edges cut by the side edge cutter 3 in the film supply unit 2. The film F is brought into a state where two sheets of band-shaped sheet are superposed.

Immediately after that, the film F passes through a pair of vertical seal units 4 and its first side edge Fa is heat-sealed. As a result, the vertical seal T1 is formed on the first side edge Fa of the film F without a gap. On the other hand, a second side edge Fb of the film F is left in a cut-open state.

And the film F has the feeding direction changed by the guide roller 5 to the perpendicular direction downward and is fed toward the bag-making/filling unit 7.

Subsequently, the film F is fed downward in the bag-making/filling unit 7, and the second side edge Fb is spread by the nozzle 10. Since the film F is a film manufactured by the inflation method, an inside surface of the film F is brought into contact with an outside air for the first time at this point of time.

The bag-making/filling unit 7 is accommodated in a clean room in which the cleanliness is controlled to a predetermined level or less. Thus, adhesion of dusts to the inside surface of the film F is prevented.

(Tubular Film Forming Step B2)

As illustrated in FIG. 6, the film F is fed further downward.

Then, the Y-shaped sealing and bag-making unit 11 forms the pair of transverse seals Y1 extending in the transverse direction on the film F. The non-welded portion (opening portion H) is formed at the insertion portion (between the pair of transverse seals Y1) of the nozzle 10.

At the same time, the vertical seal T2 is formed without a gap on the second side edge Fb of the film F by the Y-shaped sealing and bag-making unit 11.

(Corner Cutting-Off Step B3)

As illustrated in FIG. 6, the corner cutter 14 cuts off the four corners of the bag body Fg. In the both side edges of the film F, the portion (triangular non-welded portion) excluding the transverse seals Y1.

As a result, a plurality of the octagonal bag bodies Fg is continuously formed.

As described above, the plurality of bag bodies Fg communicating with each other through the opening portion H is continuously formed in the film F. In other words, the film F is formed into a tubular shape by way of the Y-shaped sealing and bag-making unit 11 and the like.

The film F formed into the tubular shape is held from both sides by the film-feeding unit 8 below the Y-shaped sealing and bag-making unit 11.

(First Sealing-Off Step S1)

As illustrated in FIG. 6, the film F is fed further downward, passes through the upper shaping unit 40, and advances between the sealing-off unit 15 (heater bars 16 and 17).

The sealing-off unit 15 heat-seals the opening portion H on the lower side of the bag body Fg1 arranged at the lowermost end of the film F. The transverse seal Y2 is formed, and the opening portion H on the lower side of the bag body Fg1 is closed.

Therefore, a bottom is formed over the whole region in the transverse direction on the bag body Fg1.

Then, the sealing-off unit 15 (heater bars 16 and 17) is separated from the film F.

Substantially at the same time as the first sealing-off step, the seal cooling step, and the separating step (end portion separation) which will be described later may be performed as necessary.

(Content Supply Step S2)

Subsequently, the nozzle 10 starts supply of the contents X toward the inside of the film F.

As illustrated in FIG. 7, the contents X start to be filled in the bag body Fg1 arranged at the lowermost end of the film F.

With regard to the film F, the bag body Fg1 is filled with the contents X and the film F is suspended by the weight.

(Intermittent Feeding Step S3)

Subsequently, the film-feeding unit 8 intermittently feeds the film F.

As illustrated in FIG. 8, a conveying distance (pitch P) of the film F is matched with the length of the bag body Fg in the longitudinal direction (vertical direction). Thus, the opening portion H on the upper side of the bag body Fg1 arranged at the lowermost end advances between the sealing-off unit 15.

(Lower-Side Shaping Step S4)

Subsequently, the lower shaping unit 30 (pair of shaping belts 31) compresses the bag body Fg1 arranged at the lowermost end.

As illustrated in FIG. 8, the pair of shaping belts 31 is opposingly moved by the driving source (not shown) and is stopped at the predetermined interval. When the film F is intermittently fed, the bag body Fg1 arranged at the lowermost end advances between the shaping belts 31.

The bag body Fg1 arranged at the lowermost end is filled with the contents X and is brought into contact with the pair of shaping belts 41, while being swollen. The bag body Fg1 is intermittently fed downward while being compressed by the pair of shaping belts 31. The pair of endless track belts 32 is circulated with lowering of the bag body Fg1 arranged at the lowermost end.

And the bag body Fg1 arranged at the lowermost end is supported from below by the bottom pressor 35 (pair of support bars 36).

The nozzle 10 continues supply of the contents X. Thus, the bag body Fg arranged at the lowermost end is swollen in the thickness direction. However, this bag body Fg1 cannot be swollen more than the interval between the pair of shaping belts 31. Thus, even if the bag body Fg1 is fully filled with the contents X, the filled amount becomes constant. Quantitativity of the contents X in the bag body Fg1 is improved.

(Upper-Side Shaping Step S5)

Subsequently, the upper shaping unit 40 (pair of shaping belts 41) compresses the bag body Fg2 arranged subsequent (second) to the lowermost end.

As illustrated in FIG. 8, when the nozzle 10 continues supply of the contents X, the contents X overflow from the bag body Fg1 arranged at the lowermost end. The contents X start to be supplied also to the bag body Fg2 arranged subsequent to the lowermost end.

The pair of shaping belts 41 is fixed at an interval narrower than the pair of shaping belts 31. Thus, the contents X reach the bag body Fg3 arranged at a third from the lowermost end. The contents X exceed the lower end 10*a* of the nozzle 10 and reach even above the upper shaping unit 40.

When the contents X are supplied to a position largely higher than the bag body Fg1 arranged at the lowermost end, the air (air bubbles) having entered into the bag body Fg1 can be moved upward easily. The contents X are spread upward, and the pressure (water pressure) of the contents X becomes high. Moreover, the air bubbles are joined to each other, and buoyancy is increased. Thus, the air bubbles begin to move upward. Therefore, the air escapes upward from the bag body Fg1 arranged at the lowermost end and the bag body Fg2 arranged subsequent to that.

(Second Sealing-Off Step S6)

As illustrated in FIG. 9, when the contents X reach above the upper shaping unit 40, the nozzle 10 stops supply of the contents X.

Subsequently, the sealing-off unit 15 heat-seals the film F in the transverse direction and forms the bag body Fg fully filled with the contents X.

The opening portion H on the upper side of the bag body Fg1 arranged at the lowermost end has already advanced between the sealing-off unit 15 (heater bars 16 and 17).

The sealing-off unit 15 heat-seals the opening portion H on the upper side of the bag body Fg1 arranged at the lowermost end of the film F and forms the transverse seal Y2.

As a result, the bag body Fg1 has its entire periphery closed and becomes the complete bag body Fg. The bag body Fg1 becomes the four-side seal type film packaging bag G in which the contents X are sealed.

Moreover, the air has escaped from the bag body Fg1 arranged at the lowermost end, and the contents X are fully filled in the film packaging bag G.

The second sealing-off step also serves as the aforementioned first sealing-off step. That is because the opening portion H on the upper side of the bag body Fg1 arranged at the lowermost end is also the opening portion H on the lower side of the bag body Fg2 formed subsequent to the lowermost end.

(Clamping Step S7)

As illustrated in FIG. 9, substantially at the same time as the second sealing-off step, the film clamp 21 grasps the film F over the whole region in the transverse direction.

The film clamp 21 grasps the film F over the whole region in the transverse direction substantially at the same time as the sealing-off unit 15. Thus, the contents X cannot be moved any more in the up-and-down direction (between the bag body Fg1 and the bag body Fg2) through the opening portion H. The film clamp 21 divides the contents X into the upper part and the lower part. Therefore, the opening portion H is brought into close contact, and heat-sealing by the sealing-off unit 15 is made easy.

The film clamp 21 supports the weight of the contents X present above the transverse seal Y1 immediately above the sealing-off unit 15. Thus, the transverse seal Y2 formed on the opening portion H is prevented from being peeled off by the weight of the contents X. Wrinkles in the transverse seal Y2 of the film F are prevented by the weight of the contents X.

When the film clamp 21 grasps the film F, the lower shaping unit 30 and the bottom pressor 35 are separated from the film F.

As illustrated in FIG. 10, when the sealing-off unit 15 has formed the transverse seal Y2, it separates from the film F.

On the other hand, the film clamp 21 continuously holds the film F from both sides after that. It is for preventing the transverse seal Y2 from being peeled off.

(Seal Cooling Step S8)

Subsequently, the cooling and cutting unit 25 performs cooling/solidification of the transverse seal Y2 and separation of the film packaging bag G containing the contents.

First, as illustrated in FIG. 11, the cooling and cutting unit 25 cools/solidifies the transverse seal Y2 immediately before the separating step.

The cooling and cutting unit 25 is arranged substantially at the same position as the sealing-off unit 15. Thus, the cutting cooling bars 26 and 27 are opposingly moved, and the transverse seal Y2 is pressurized.

The cooling and cutting unit 25 cools the transverse seal Y2 while pressurizing it for the time being. As a result, the transverse seal Y2 is completely solidified.

Therefore, the film packaging bag G becomes a sealed bag, and the contents X are sealed (fully filled).

(Separating Step S9)

Subsequently, the cooling and cutting unit 25 separates the film packaging bag G containing the contents from the film F.

First, as illustrated in FIG. 12, the film clamp 21 is separated from the film F. Subsequently, the cooling and cutting unit 25 moves a cutter (not shown) of the cutting cooling bar 26 toward the cutting cooling bar 27. Then, the transverse seals Y1 and Y2 are cut (divided vertically into two parts) along the transverse direction.

As a result, as illustrated in FIG. 13, the film packaging bag G containing the contents is cut off from the lowermost end of the film F.

(Repeating Step)

When the film packaging bag G containing the contents is cut off from the film F, the contents X are supplied into the film F again from the nozzle 10. As illustrated in FIGS. 13 and 7, the routine returns to the aforementioned content supply step S2.

At this time, since the second sealing-off step S6 also serves as the first sealing-off step S1, the first sealing-off step S1 has been completed prior to the content supply step S2.

The content supply step S2 may be resumed before the separating step S9 is completed. The content supply step S2 may be resumed immediately after the seal cooling step S8 is completed.

After that, the content supply step S2, the intermittent feeding step S3, the lower-side shaping step S4, the upper-side shaping step S5, the second sealing-off step S6 (first sealing-off step S1), the clamping step S7, the seal cooling step S8, and the separating step S9 are repeated.

As a result, the film packaging bags G containing the contents are consecutively manufactured.

As described above, when the contents X are to be supplied to the bag body Fg1 arranged at the lowermost end of the film F, the lower shaping unit 30 regulates the swelling of this bag body Fg1. At the same time, the upper shaping unit 40 regulates the swelling of the bag body Fg2 arranged subsequent to the lowermost end.

Thus, the contents do not enter more than necessary into the bag body Fg1 arranged at the lowermost end. The air having entered into the bag body Fg1 arranged at the lowermost end is moved upward.

Therefore, according to the vertical bag-making/filling machine 1 and the method for manufacturing the film packaging bag G containing the contents, quantitativity of the contents X of the film packaging bag G is improved. The contents X can be fully filled without leaving air inside the film packaging bag G.

The lower shaping unit 30 and the upper shaping unit 40 comprise the pair of endless track belts 32 and 42 compressing the film F such that it can move downward, respectively and thus, they can feed the film F downward while regulating the swelling of the film F (bag body Fg).

Since the upper shaping unit 40 has the regulation thickness smaller than that of the lower shaping unit 30 and has the regulation length longer than that of the lower shaping unit 30, the contents X are filled to a position higher than the bag body Fg1 arranged at the lowermost end. Thus, the pressure (water pressure) of the contents X becomes high, and the air bubbles supplied together with the contents X can be moved upward more easily. The air bubbles are joined to each other, buoyancy is increased, and the air bubbles can be moved upward more easily.

Since the upper shaping unit 40 is arranged at the position where the upper shaping unit 40 contains the lower end 10*a* of the nozzle 10, the air discharged from the nozzle 10 can be moved to above the upper shaping unit 40 more easily.

The film clamp 21 grasps the film F over the transverse direction flatly immediately above the sealing-off unit 15. Thus, the contents X filled in the film F is divided into the upper part and the lower part. Therefore, the formation of the transverse seal Y2 by the sealing-off unit 15 can be smoothly performed.

The transverse seal Y2 can be prevented from being peeled off by the weight of the contents X or from being wrinkled. Therefore, liquid leakage from the film packaging bag G containing the contents can be prevented.

The cooling and cutting unit 25 is arranged at the same position as the sealing-off unit 15 and cools the transverse seal Y2 formed by the sealing-off unit 15. Thus, the transverse seal Y2 is rapidly solidified, and liquid leakage can be prevented. Therefore, the manufacturing efficiency of the film packaging bag G containing the contents can be improved.

The film F is an inflation film, and after the side edge is cut off by the side edge cutter, the vertical seal unit 4 and the Y-shaped sealing and bag-making unit 11 (sealing and bag-making unit) form a plurality of incomplete bag bodies Fg communicating with each other on the film F.

Thus, the film packaging bag G containing the contents can be manufactured under an extremely hygienic condition in which foreign substances, germs or the like cannot enter easily into the film F (inside of the film packaging bag G).

Since the film F is bonded by the transverse seal Y1 before the contents X are supplied, even if the weight of the contents X is large, the film F (bag body Fg) is not made wavy easily. Therefore, quantitativity of the contents X of the film packaging bag G is improved.

Since the Y-shaped sealing and bag-making unit 11 heat-seals the four corners of the bag body Fg in the diagonal direction, the bag body Fg has an octagonal shape. Thus, even if the weight of the contents X is large, the transverse seal Y1 of the bag body Fg is not made wavy easily.

If the bag body Fg has a square shape, the vicinities of the four corners of the bag body Fg become wavy as if they are dented. However, by forming the bag body Fg having an octagonal shape, the bag body Fg is not made wavy easily since it has no four corners.

Since the corner cutter cuts off the four corners of the bag body Fg, injury of a worker when the film packaging bag G containing the contents is handled can be prevented.

When film packaging bags each having four corners are accommodated in a cardboard box and transported, the four corners of the film packaging bag and an inner surface of the cardboard box rub each other in the distribution process, and pin holes can be generated easily at the four corners. However, since the film packaging bag G has no four corners, generation of a pin hole in the conveyance process of the film packaging bag G is suppressed.

The present invention is not limited to the aforementioned embodiment but encompasses modifications which is made by applying various changes are to the aforementioned embodiment within a range not departing from the gist of the present invention. Specific shapes, configuration and the like cited in the embodiment are only examples and can be changed as appropriate.

For example, in the aforementioned embodiment, the case where the single nozzles 10 is provided is illustrated, but the number of the nozzles 10 can be increased/decreased in accordance with the type of the contents X. In this case, it is preferable that a plurality of the nozzles 10 is bundled into one bundle and arranged along the length direction of the film F.

The nozzle 10 is not limited to a case where it is arranged at the center in the transverse direction of the film F.

In the aforementioned embodiment, the case where the contents X are drinking water is illustrated, but the contents X only need to be a fluid such as a liquid state and a paste state (jelly state). The contents X may be a gas.

The contents X may be a food, a beverage, edible oil, condiments and the like. Applications of the contents X are not limited to food but may be medical such as drug solutions, industrial uses such as lubricant oil and the like.

In the aforementioned embodiment, the case where the cooling and cutting unit 25 serves both as the separating unit and the seal cooling unit (integral configuration) is illustrated, but the separating unit and the seal cooling unit may be separate (separate configuration).

In the aforementioned embodiment, the case where the vertical seal unit 4 and the Y-shaped sealing and bag-making unit 11 are separate (separate configuration) as the sealing and bag-making unit is illustrated, but the Y-shaped sealing and bag-making unit 11 may serve also as the vertical seal unit 4 (integral configuration).

The Y-shaped sealing and bag-making unit 11 is not limited to the case of forming the vertical seal T2. A seal unit for forming the vertical seal T2 may be provided separately and independently of the Y-shaped sealing and bag-making unit 11.

The Y-shaped sealing and bag-making unit 11 is not limited to the case of forming the transverse seal Y1 into the Y-shape. The Y-shaped sealing and bag-making unit 11 may form the transverse seal Y1 linearly. The bag body Fg (film packaging bag G) formed in the film F may have a square shape.

The Y-shaped sealing and bag-making unit 11 may form an arc-shaped heat seal at four corners of the bag body Fg.

A shape of the seal unit (pouch) of the film packaging bag G may be circular, diamond, polygonal and the like, for example.

In the aforementioned embodiment, the case where the film F is an inflation film is illustrated, but this is not limiting. The film F may be such that two band-shaped sheets are stacked.

The film F may be such that one sheet is folded once in the transverse direction and then, stacked. The film packaging bag G may be a three-side seal type.

The case where a mouth plug is attached to film packaging bag G.

Arrangement of the vertical seal unit 4, the film-feeding unit 8, and the Y-shaped sealing and bag-making unit 11 can be changed as appropriate.

However, the film-feeding unit 8 (roller 9) is preferably arranged as lower as possible. That is because if the transverse seal Y1 is subjected to a driving force of the roller 9 in a not sufficiently cooled state, there is a concern that the transverse seal Y1 gets a trace of the roller.

REFERENCE NUMERALS

1 vertical bag-making/filling machine
3 side edge cutter
4 vertical seal unit (sealing and bag-making unit)
8 film-feeding unit
10 nozzle
10*a* lower end
11 Y-shaped sealing and bag-making unit (sealing and bag-making unit)
14 corner cutter
15 sealing-off unit
21 film clamp
25 cooling and cutting unit (separating unit, seal cooling unit)
30 lower shaping unit
32 endless track belt
35 bottom pressor
40 upper shaping unit
42 endless track belt
F film
Fa first side edge
Fb second side edge
Fg, Fg1, Fg2, Fg3 bag body
T1, T2 vertical seal
Y1, Y2 transverse seal
H opening portion (insertion portion)
G film packaging bag (bag body)
X content
P pitch
B1 side edge cutting step
B2 tubular film forming step
B3 corner cutting-off step
S1 first sealing-off step
S2 content supply step
S3 intermittent feeding step
S4 Lower-side shaping step
S5 upper-side shaping step
S6 second sealing-off step
S7 clamping step
S8 seal cooling step
S9 separating step

The invention claimed is:

1. A vertical bag-making/filling machine comprising:

a film-feeding unit which intermittently feeds a film formed into a tubular shape downward;

a nozzle extending downward along a length direction of the film and supplying contents into the film;

a sealing-off unit arranged below a lower end of the nozzle and forming a bag body by heat-sealing the film in a transverse direction;

a lower shaping unit arranged below the sealing-off unit and regulating swelling of the film in a thickness direction when the contents are supplied from the nozzle;

an upper shaping unit arranged above the sealing-off unit and regulating the swelling of the film in the thickness direction when the contents are supplied from the nozzle; and a separating unit for separating the bag body fully filled with the contents by cutting a transverse seal formed by the sealing-off unit;

wherein the upper shaping unit is arranged at a position where the upper shaping unit contains a lower end of the nozzle;

wherein the upper shaping unit is divided and arranged on both sides in the transverse direction with sandwiching the nozzle and a regulation thickness configured to be set smaller than the outer diameter of the nozzle;

wherein the contents are filled to a position above the upper shaping unit, and the transverse seal is formed by the sealing-off unit in a state where air bubbles contained in the contents move upward from the upper shaping unit;

wherein the upper shaping unit is distinct and separate from the lower shaping unit; and wherein each of the lower shaping unit and the upper shaping unit comprises a pair of endless track belts compressing the film such that the film is configured to move downward.

2. The vertical bag-making/filling machine according to claim 1, wherein the upper shaping unit has a regulating thickness smaller than the lower shaping unit.

3. The vertical bag-making/filling machine according to claim 1, wherein the vertical bag-making/filling machine comprises a film clamp arranged immediately above the sealing-off unit and grasping the film over the transverse direction flatly and dividing the contents filled in the film to an upper part and a lower part.

4. The vertical bag-making/filling machine according to claim 1, wherein the vertical bag-making/filling machine comprises a seal cooling unit arranged at a same position as the sealing-off unit and cooling the seal formed by the sealing-off unit.

5. The vertical bag-making/filling machine according to claim 1, wherein the film is an inflation film which is compressed to flat and inside surfaces are in close contact with each other, and the vertical bag-making/filling machine comprises:

a side edge cutter for cutting a side edge of the film along a longitudinal direction; and a sealing and bag-making unit arranged above the lower end of the nozzle, heat-sealing the side edge of the film along the longitudinal direction and heat-sealing the film in the traverse direction excluding an insertion portion of the nozzle so as to form an incomplete bag body.

6. The vertical bag-making/filling machine according to claim 5, wherein the sealing and bag-making unit heat-seals four corners of the bag body in a diagonal direction.

7. The vertical bag-making/filling machine according to claim 6, wherein the vertical bag-making/filling machine comprises a corner cutter for cutting off the four corners.

8. A method for producing a content-filled film packaging bag comprising:

a first sealing-off step of heat-sealing a tubular film arranged to be feedable downward by a sealing-off unit so as to form a bag body;

a supply step of supplying contents into the film from a nozzle arranged above the sealing-off unit and extending downward along a length direction of the film;

a step of intermittently feeding the film downward by a film-feeding unit;

a lower-side shaping step for regulating swelling of the film by compressing the film in a thickness direction by a lower shaping unit arranged below the sealing-off unit;

an upper-side shaping step for regulating the swelling of the film by compressing the film in the thickness direction by an upper shaping unit arranged above the sealing-off unit;

a second sealing-off step of forming the bag body fully filled with the contents by heat-sealing the film in the traverse direction by the sealing-off unit; and a separating step of separating the bag body fully filled with the contents by cutting off a traverse seal formed by the sealing-off unit by a separating unit;

wherein in the supply step, the contents are discharged from the nozzle at a lower end side of the upper shaping unit;

in an upper-side shaping step, the upper shaping unit is arranged at a position where the upper shaping unit contains a lower end of the nozzle, and the upper shaping unit is divided and arranged on both sides in the transverse direction with sandwiching the nozzle and a regulation thickness configured to be set smaller than the outer diameter of the nozzle, and the contents are raised to a position which is higher than the upper shaping unit;

in the second sealing-off step, the transverse seal is formed by the sealing-off unit in a state where air bubbles contained in the contents move upward than the upper shaping unit;

wherein the upper shaping unit is distinct and separate from the lower shaping unit; and wherein each of the lower shaping unit and the upper shaping unit comprises a pair of endless track belts compressing the film such that the film is configured to move downward.

9. The method for producing the content-filled film packaging bag according to claim 8, wherein the second sealing-off step also serves as the first sealing-off step.

10. The method for producing the content-filled film packaging bag according to claim 8, wherein the upper shaping unit has a regulation thickness smaller than the lower shaping unit.

11. The method for producing the content-filled film packaging bag according to claim 8, wherein the method comprises, at the same time as the second sealing-off step, a step of grasping the film and dividing the contents filled in the film into an upper part and a lower part by a film clamp arranged immediately above the sealing-off unit flatly over the transverse direction.

12. The method for producing the content-filled film packaging bag according to claim 8, wherein the method comprises, immediately before the separating step, a step of cooling the transverse seal formed by the sealing-off unit by a seal cooling unit arranged at the same position as the sealing-off unit.

13. The method for producing the content-filled film packaging bag according to claim 8, wherein the film is an inflation film which is compressed to flat and inside surfaces being in close contact with each other, and the method comprises, prior to the first sealing-off step:

a step of cutting off a side edge of the film along a longitudinal direction by a side edge cutter; and a step of forming an incomplete bag body by heat-sealing the side edge of the film along the longitudinal direction and heat-sealing the film in the traverse direction excluding an insertion portion of the nozzle by a sealing and bag-making unit arranged above the lower end of the nozzle.

14. The method for producing the content-filled film packaging bag according to claim 13, wherein the sealing and bag-making unit heat-seals four corners of the bag body in a diagonal direction.

15. The method for producing the content-filled film packaging bag according to claim 14 comprising a step of cutting off the four corners by a corner cutter.

* * * * *